United States Patent [19]

Sparrow

[11] 3,986,763

[45] Oct. 19, 1976

[54] ELECTRIC SOCKETS

[75] Inventor: Frederick Gordon Sparrow, Sutton Coldfield, England

[73] Assignee: Midland Electric Manufacturing Company, Birmingham, England

[22] Filed: Oct. 15, 1975

[21] Appl. No.: 622,540

[52] U.S. Cl. ..... 339/40

[51] Int. Cl.[2] ..... H01R 13/44

[58] Field of Search ..... 339/40–42, 339/184 R, 184 M, 185 R

[56] References Cited

UNITED STATES PATENTS

| | | | |
|---|---|---|---|
| 2,740,943 | 4/1956 | Young | 339/40 |
| 3,222,631 | 12/1965 | Cohen | 339/40 |

FOREIGN PATENTS OR APPLICATIONS

| | | | |
|---|---|---|---|
| 697,319 | 9/1953 | United Kingdom | 339/41 |

*Primary Examiner*—Joseph H. McGlynn
*Assistant Examiner*—Craig R. Feinberg
*Attorney, Agent, or Firm*—Brisebois & Kruger

[57] ABSTRACT

A shuttered electrical socket for use with either a three pin plug or a two pin plug has a housing with a front panel having spaced first and second pin-receiving holes and a third hole which is between the first and second holes but is displaced slightly from the imaginary line joining those holes; the third hole receives an earth pin if provided on the plug. A platform is located below the front panel and carries a shutter member which can slide both parallel to, and transversely to, the imaginary line. The shutter member has locking portions which cooperate with complementary parts on the housing or platform preventing movement of the shutter member parallel to the line to its open position, unless it has been first displaced in the transverse direction.

The shutter member is biased to the closed position and to a transverse position in which the locking portions are effective. When pins are simultaneously introduced into the first and second holes they first engage cam surfaces on the shutter member causing the latter to be displaced transversely to render the locking portions ineffective. Then the pins engage ramp surfaces on the shutter member causing it to move parallel to the imaginary line to the open position in which the pins can pass through the platform to engage contacts below it.

9 Claims, 3 Drawing Figures

ELECTRIC SOCKETS

This invention relates to electrical sockets of the type used in domestic, office and industrial premises as medium power outlets in conjunction with coacting plugs.

Shuttered electrical sockets are very well known, in which a shutter member or members obstruct the pin-receiving holes of the socket to prevent access to the current-carrying contacts within the socket except when a plug of correct design is presented to the socket. Usually, such shuttered sockets are designed for use with three pin plugs having an earth pin; in that case, the shutter mechanism is operated by the entry of the earth pin to remove the shutter member or members from blocking access of the current-carrying pins to the respective socket contacts.

A new design of plug and socket has now been proposed as an international standard. The socket has three pin receiving holes consisting of spaced first and second holes to receive two current-carrying pins of a plug, and a third hole between the first and second holes but slightly offset from an imaginary line joining the first and second holes. The socket is to be used with either a three pin socket, having an earth pin to be received in the third hole, or a two pin plug having no such earth pin.

The shuttering of such a socket presents problems since clearly the shutter member or members cannot be designed to be operated by an earth pin. If the shutter mechanism is operated by a current-carrying pin, then it must be proof against tampering.

An object of the invention is to provide a shutter mechanism for socket capable of receiving alternatively a two pin plug and a three pin plug, the shutter mechanism being operated by two current carrying pins of a plug, entered into the first and second holes of the socket simultaneously.

Another object is to prevent the shutter mechanism being operated to permit access to the socket contacts when an object is inserted into one only of the first and second holes.

A further object is to provide a shutter member which will not obstruct the entry of an earth pin of a plug, whatever the position of the shutter member.

A still further object is to provide a shutter member which can slide parallel to a front panel in which the three pin receiving holes are located and which must be moved transversely to the line joining the first and second holes before it can be moved parallel to that line to allow access to the contacts.

These and other objects of the present invention will become more apparent from the following description with reference to the accompanying drawings, in which.

Figure 1:
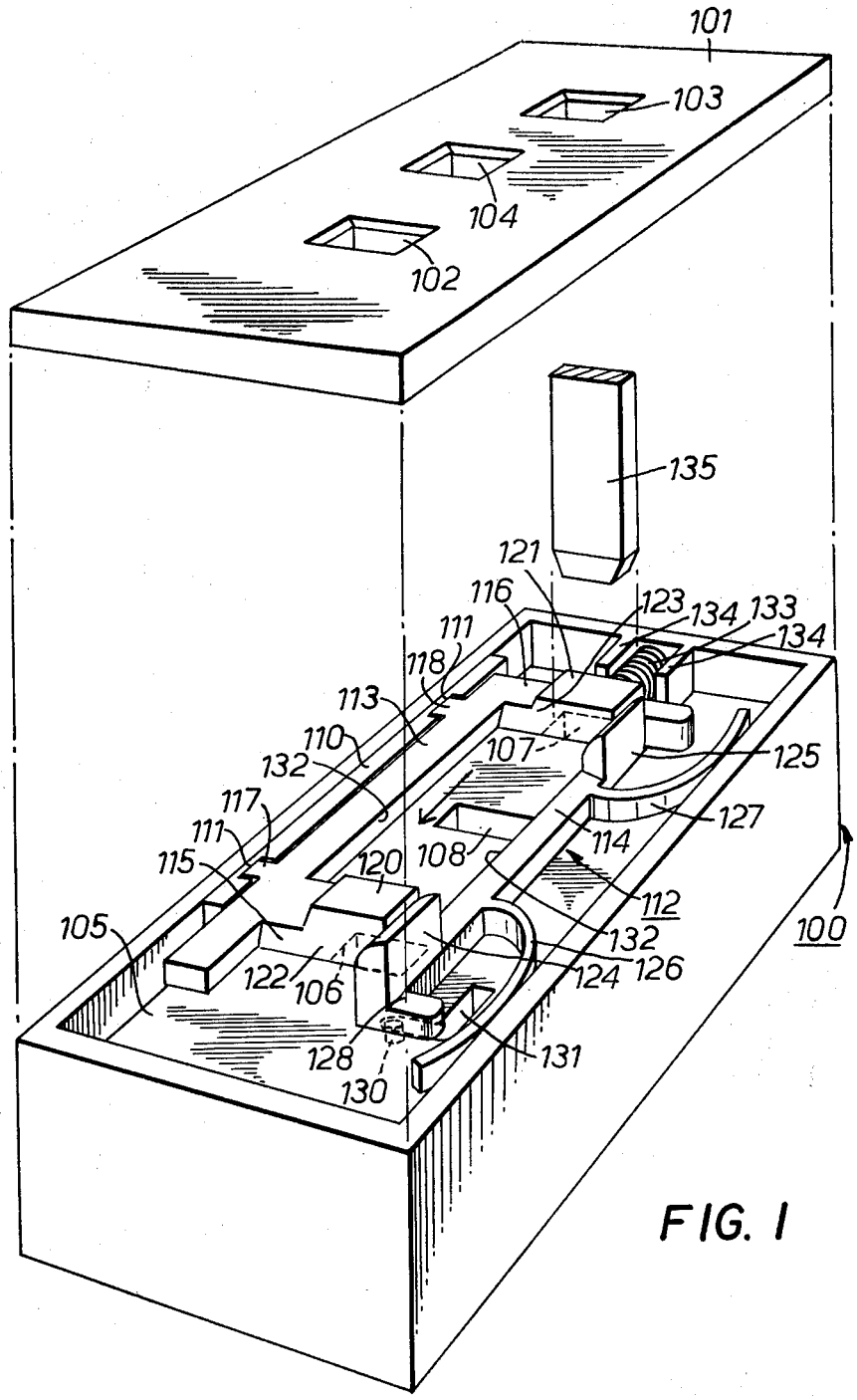
FIG. 1 is a perspective view of a shuttered socket according to the invention.
Figure 2:
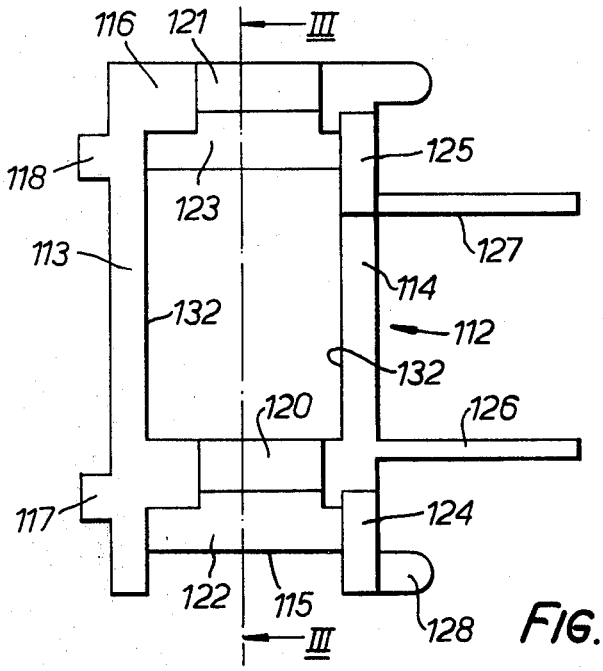
FIG. 2 is a plan view of the shutter member only.
Figure 3:
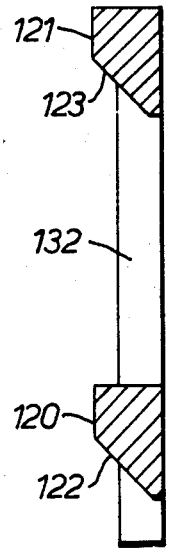
FIG. 3 is a sectional view taken through the shutter member along the line III—III of FIG. 2.

The socket shown in the figure consists of a box-like housing 100 and a front panel in the form of a cover 101, the latter being shown removed from the housing for the sake of clarity. The cover has three pin-receiving holes 102, 103 and 104, of which the middle hole 104 is offset slightly from the imaginary line joining the other holes 102, 103 and receives the earth pin of a three-pin plug (not shown).

The housing 100 is rectilinear in form and is hollow. An insulated platform 105 is secured in the housing at a level below the tops of the housing walls, and has three rectangular holes 106, 107, 108 which are aligned with holes 102, 103, 104 when the cover 101 is positioned on the housing, and with aligned electrical contacts of conventional design disposed below the platform 105. One of the longer walls of the housing carries a plate 110 on its inner face, that plate being formed with two spaced recesses 111.

A shutter chamber is formed between the platform 105 and the underside of the cover 101 when the latter is mounted on the housing, and a shutter member indicated generally at 112 is located in that chamber, being seated on the platform 105 so that it can slide within the chamber in a direction parallel to the imaginary line joining the pin holes, and also at right angles to that line.

The shutter member is a single moulding made from a synthetic resin, such as nylon, having a degree of resilience. It has the following parts a. two bars 113, 114 extending lengthwise of the shutter chamber, i.e. parallel to the imaginary line;

b. two cross-members 115, 116 connecting bars 113, 114;

c. two projections 117, 118 extending laterally of the bar 113 and normally received in recesses 111;

d. blocks 120, 121 formed on the upper faces of cross members 115, 116 respectively and having parallel ramp surfaces 122, 123; in the closed position of the shutter member as shown, the blocks 120, 121 overlie the holes 106, 108 and prevent access of the respective plug pins to the electrical contacts;

e. cams 124, 125 projecting upwardly from bar 114 adjacent blocks 120, 121 respectively but displaced slightly lengthwise from those blocks, and having cam surfaces.

f. arcuate, resilient, tension arms 126, 127 extending from bar 114, engaging a side wall of the shutter chamber and biasing the shutter member towards the other side wall; and g. finger 128 laterally extending from bar 114 adjacent cam 124 carrying a downwardly directed peg 130 which is received in a slot 131 in platform 105; slot 131 has a reverse L-form as shown, with a longitudinal part extending in the lengthwise direction of the shutter member and a transverse part extending laterally.

As will be apparent, the shutter member 112 has a central opening 132 which is bounded by the bars 113, 114 and by the cross members 115, 116 and which allows access at all times to hole 108. The shutter member is biased in the direction of the arrow by a compression spring 133 disposed between an end wall of the shutter chamber and the cross-member 116, so that the pin 130 is normally located in the lateral part of the slot 131. The spring is disposed between two abutments 134 extending inwardly from that end wall, and acting as stops for the shutter member in the opposite direction.

When the socket is in the disposition shown in the figure and with the cover 101 secured to the housing 100, the shutter member is in its shut position with the blocks 120, 121 lying immediately between holes 102 and 106 and holes 103 and 107, respectively. If a two-pin or three-pin plug is introduced to the socket, the live and neutral pins, one of which is shown at 135, pass through holes 102 and 103 and first engage the cam surfaces of cams 124, 125 resulting in the bodily movement of the shutter member away from plate 110 to disengage projections 117, 118 from recesses 111 and to bring peg 131 to the longitudinal part of slot 131. Next, the pins engage the ramp surfaces 122, 123 of blocks 120, 121 and progressively move the shutter member lengthwise in the direction opposite to that of the arrow, the peg 130 moving along the longitudinal part of slot 131; that movement, which is effected against the bias of spring 133, continues until the open position of the shutter member is reached, when the pins clear the ramp surfaces and enter holes 106, 107. The central opening 132 of the shutter member is so large that the hole 108 for the central earth pin, if provided, is unobstructed in all positions of the shutter member.

Provided the pins are inserted in holes 102, 103 substantially simultaneously, the shutter member is urged first laterally and then lengthwise of the shutter chamber to enable those pins to enter holes 106, 107 and obtain access to the supply contacts below platform 105. If, however, a pin or other object is inserted in hole 102, without a similar device being presented to hole 103, its engagement with cam 124 causes lateral movement to release projection 117 from its recess 111, but projection 118 is not so released and lengthwise movement of the shutter member to the open position is blocked. Similarly, if an object is introduced to hole 103, but not simultaneously to hole 102, projection 118 is released from its recess 111, but projection 117 is held captive and peg 130 remains in the transverse part of slot 131, so that again lengthwise movement of the shutter member to the open position is prevented and access to the holes 106, 107 and the electrical contacts is blocked.

On removal of a two- or three- pin plug from the socket, spring 133 returns the shutter member in the direction of the arrow and to the shut position. When peg 130 again reaches the transverse part of slot 131, the tension arms 126, 127 urge the shutter member laterally so that projections 117, 118 are again engaged in their recesses.

Peg 130, which is fixed to the shutter member, operates in reverse L-shaped slot 131 in platform 105 so as to prevent partial opening of the shutter member 112 by the insertion of a fine metallic object, such as a pin, into hole 102. Without the peg 130, the insertion of such an object into hole 102 would cause pivoting of the shutter member about projection 118 sufficient to allow access of the object to the electrical contact below hole 106; however, peg 130 and its slot 131 prevent the occurrence of such pivoting action.

I claim:

1. An electrical socket comprising a housing including a front panel formed with spaced first and second holes to receive current-carrying pins of a coacting plug, and a third hole between those holes but slightly offset from an imaginary line joining the first and second holes for receiving an earthing pin of said plug, said holes being aligned with electrical contacts within said housing;

a shutter member located behind said front panel and movable parallel to said front panel in directions transverse to said imaginary line, said shutter member being also movable parallel to said imaginary line between a shut position and an open position, said shutter member having parts which obstruct said first and second holes when said shutter member is in said shut position, but which permit passage of pins through said first and second holes to said contacts when said shutter member is in said open position;

cooperating locking means on said shutter member preventing movement of said shutter member parallel to said imaginary line prior to movement transverse to said line;

first biasing means biasing said shutter member to said shut position;

second biasing means biasing said shutter member transversely to said line to bring said locking means into effect; and cam members on said shutter member engageable by pins entered through said first and second holes to move said shutter member first, transverse to said line to disengage said locking means, and, second, to move said shutter member from said shut position to said open position, said shutter member having an opening therein aligned with said third hole in all positions of said shutter member and permitting passage of said earth pin therethrough.

2. A socket according to claim 1, in which said housing has a platform which is spaced from said front panel and on which said shutter member is slidably carried for movement parallel and transversely to said line.

3. A socket according to claim 2, in which said platform has pin-receiving holes aligned with said first, second and third holes and, in said shut positon of said shutter member, covered by said parts.

4. A socket according to claim 3 in which said shutter member carries a peg, and said platform has a slot which receives said peg, and which is shaped to prevent movement of said shutter member to said open position before the transverse movement.

5. A socket according to claim 1 in which said cam members include ramp surfaces separately engageable by pins entered through the first and second holes when the shutter member is in said shut position, and effective to cause movement of the shutter member to the open position on continued entry of those pins.

6. A socket according to claim 5, in which said cam members further include cam surfaces separately engageable by pins entered through the first and second holes prior to contact of those pins with said ramp surfaces, and effective to cause the transverse displacement of said shutter member.

7. A socket according to claim 1 in which said locking means comprise projections on said shutter member and corresponding receses in said housing, said projections being removable from said recesses on movement of said shutter member only in the transverse direction.

8. A socket according to claim 1, in which said second biasing means comprise a resilient arm or arms carried by said shutter member, and engaging a side wall of the housing.

9. A socket according to claim 1, in which said shutter member comprises two lengthwise and two connecting cross members, said opening for the earth contact being bounded by said lengthwise and connecting cross members.

* * * * *